United States Patent [19]

Diekman

[11] 4,083,192

[45] Apr. 11, 1978

[54] PILING ALIGNMENT SYSTEM

[76] Inventor: Mark T. Diekman, Rte. 1, Box 53, Cheboygan, Mich. 49721

[21] Appl. No.: 736,124

[22] Filed: Oct. 27, 1976

[51] Int. Cl.[2] ..... E02D 5/16

[52] U.S. Cl. ..... 61/63; 61/60

[58] Field of Search ..... 61/63, 535, 60, 58; 269/47; 294/108, 106, 111

[56] References Cited

U.S. PATENT DOCUMENTS

| | | | |
|---|---|---|---|
| 829,596 | 8/1906 | Nolty | 61/60 |
| 2,161,482 | 6/1939 | Miller | 61/63 |
| 2,968,931 | 1/1961 | McGrath | 61/63 |
| 3,019,608 | 2/1962 | Marmion | 61/63 |

*Primary Examiner*—Jacob Shapiro

*Attorney, Agent, or Firm*—McGarry & Waters

[57] ABSTRACT

A piling alignment system having a pile setter and a quick release shackle for aligning interlocking edges of a set piling and a suspended piling which is being positioned for setting. The setter has an upper lip portion adapted to abut the bottom portion of a suspended piling and means for rigidly connecting the setter to the piling. The setter, when mounted onto the suspended piling, has a vertical groove in alignment with the surface of the female interlocking edge of the suspended piling. Prongs are mounted at the sides of the groove at a lower portion thereof and extend outwardly with a space therebetween for guiding the setter vertical groove into alignment with the male interlocking edge of the set piling so that the suspended piling can be lowered into interlocking relationship with the set piling. A quick release shackle has two vertically extending flanges adapted to receive the upper portion of a piling therebetween. A pin extends through an aperture in the two flanges and engages the piling through an aperture extending therethrough. A lever extending from the flange is operably connected to the pin through a coupling mechanism. A lanyard is connected to the end of the lever and is operable from the ground level. The pin disengages from the piling when the lanyard is pulled.

13 Claims, 8 Drawing Figures

PILING ALIGNMENT SYSTEM

BACKGROUND OF THE INVENTION

1. Field of the Invention

This invention relates to a system for threading together adjacent individual sections of sheet metal piling and more particularly to a system for threading together adjacent individual sections of sheet metal piling so as to enable workmen to operably thread the adjacent pilings from the ground level position.

2. Description of the Prior Art

In the construction of dams, or other structures wherein sand, cement, earth, or other particulate materials having a tendency to spread must be prevented from so spreading, the use of metal pilings interlocking with other metal pilings to form a wall has been common place.

However, the interlocking of the metal piling sections with one another has been no easy task. A crane is needed to suspend a metal piling over the top edge of an adjacent metal piling so that the edges may be aligned. Once the metal piling edges are aligned, the crane then lowers the metal piling into place. The problem with the alignment is that the metal piling is suspended from a cable wherein the metal piling is movable under stress from winds or lateral movements of the crane. On the other hand, the male interlocking edge must be precisely aligned with the female interlocking edge. Horizontal positions of the edges must coalign. Further, the two pile sections must also be coaligned and not skewed with respect to each other in order for the two pile sections to slide together in an interlocked position. The crane alone cannot adequately align the edge of the suspended piling section with the complementary edge of the set piling section particularly with respect to the skew of the two pile sections.

Conventionally, a man sits on top of the last set piling so he may grab the suspended piling and adequately align the complementary interlocking edges before the crane lowers the set piling into place. The man has to have great agility in sitting on top of a thin metal sheet piling many feet from the ground and subject to unknown factors such as winds, heavy rains, or the direction of the swinging piling. The suspended piling often weighs thousands of pounds and can easily swing and knock the man off his perch. Consequently, because of the risks which are routinely encountered by the man atop the pile sections, construction of pilings is usually halted with the advent of inclement weather which multiplies the risks involved.

Certain safety improvements have been developed to minimize the risks which a man may encounter. One such development is disclosed in the U.S. Pat. No. 2,833,119 issued to Molloy on May 6, 1958. The Molloy patent discloses a safety lock wherein the suspended metal piling has attached to its bottom edge an elongated arm having a pair of spaced arm plates vertically spaced below the elongated arm and extending horizontally upward therefrom. The set piling fits within the space provided and a latch pin extends into the space to latch the bifurcated section of the locking device to the set piling so that the latching device cannot escape outwardly therefrom. The suspended piling is then raised so its lower edge is just above the top edge of the set piling. The man atop the pilings then pulls a handle on the safety lock device so as to align the two interlocking edges. The suspended piling is then lowered with its edge interlocking with the edge of the set piling.

A device which eliminates the use of the man atop the pilings is disclosed in the U.S. Pat. No. 2,583,928 issued to Caudill on Jan. 29, 1952. The Caudill patent discloses a pile threader comprising two halves each connected to a draw bar. The two halves are connected and clamped onto the lower edge of a suspended pile section. The pair of draw bars have rollers at the ends thereof. At the other ends, an eccentrically placed cam lever is mounted thereto. The rollers engage a narrow portion of the male interlocking edge of the set piling section. A crane is used to elevate the suspended piling so its lower edge is above the top edge of the set piling. The cam lever is pulled down to move the plates that are connected to the suspended piling over toward the set piling so that the female edge of the suspended piling is aligned directly over the set piles on the male interlocking edge. The crane lowers the suspended piling so that the edges interlock. The process is then repeated as often as necessary.

Conventionally, the crane suspends the piling sections by the use of a clamp. The clamp must releasably engage the pile section as well as secure the piling without risks of slippage. A clamp used to lift heavy metal plates is disclosed in the U.S. Pat. No. 3,088,749 issued to Gowan on Nov. 14, 1961. The Gowan clamp has a pair of pinching rollers. The pinching rollers are operatively connected to a lever arm. The lever arm when in a downward position locks the pinching rollers and releases the pinching rollers when in an upward position.

SUMMARY OF THE INVENTION

According to the invention, a piling alignment system has a means for aligning adjacent interlocking edges of the two piling sections. The system further includes a suspending means attached to the pile section to elevate the pile section to a suspended position and to lower it to a set position. The aligning means includes means for fixedly attaching the aligning means to the bottom portion of a suspended pile section and means for retaining an interlocking edge of the suspended pile section within close lateral alignment with the interlocking edge of the set pile section. Preferably, the retaining means include two prongs having a lateral spacing therebetween attached to a lower portion of the aligning means. The aligning means has a surface which can abut the sides and front portion of the edge of the set pile to prevent the two pile sections from being skewed with respect to each other. The surface is preferably an extended groove shaped to enclose the set edge. Preferably the groove is shaped to be congruent with the female edge of the suspended piling but without the converging flange the female edge has so that the male set edge can laterally engage the groove and be aligned with the suspended female edge.

The system has means for guiding the aligning means from a remote distance. Preferably, the guiding means includes a rope attached to the aligning means and operable from ground level.

In operation, the suspended pile section has the aligning means attached to a bottom portion thereof. The set pile section is then placed within the spacing between the prongs. The suspended pile section is elevated to a height wherein its bottom edge is slightly above the top edge of the adjacent set pile section, and the groove is aligned laterally with the male interlocking edge of the set pile section. The rope is pulled laterally so the male interlocking edge is fitted within the groove and abuts the groove surface all along the edge thereof. The suspended pile section is lowered and the male interlocking edge slides within the female interlocking edge of the suspended pile section. The aligning means is then detached from the suspended pile section.

Further, according to the invention the suspending means of the piling alignment system is a shackle attached to an operative crane cable wherein the shackle has a protrusion which positively engages the suspended pile section. The protrusion extends through an aperture of the suspended pile section.

Preferably, the shackle has two vertically extending flanges with a space therebetween. The protrusion extends through apertures of the two flanges and spans the space therebetween. The suspended pile section fits within the space and has its upper aperture aligned with the aperture of the flanges. The shackle has a means for operating the protrusion between an engaging and disengaging position with the pile section from a remote distance.

Preferably, the operating means of the shackle has a level which is pivotably connected to the shackle. The lever operatively engages an arm which is also pivotably connected to an upper portion of the shackle. At a lower portion of the arm, the protrusion is operatively connected thereto. The lever has an upper extension which engages the arm at a point between the pivot point of the arm and the point where the protrusion is connected thereto.

Preferably, the lever has a lanyard means which is operable from ground level. Preferably, as the lanyard means is pulled, the lever is pivoted so as to pivot the arm away from the shackle so as to move the protrusion into a disengaging position, thereby releasing any suspended piling from the shackle.

Preferably, a spring means is mounted on the arm which returns the protrusion to an engaging position when the downward force on the lever ceases.

Preferably, the arm has a handle which is used to manually pivot the arm away from the shackle so as to bring the protrusion into a disengaging position.

The arm is used to secure the shackle to the pile section before the pile section is suspended. The lanyard is pulled to disengage the shackle from the pile section after the aligning means is detached from the suspended pile section and the pile section is lowered to ground level.

The invention provides for a piling alignment system that has a suspending means which can positively engage a piling so as to pick up pile sections without the risk of the piling slipping out from the suspending means. The invention further provides an alignment means for safely aligning two interlocking edges of adjacent pile sections without the use of a man atop the set pile sections and in all types of inclement weather.

DETAILED DESCRIPTION OF THE PREFERRED EMBODIMENT

Figure 1:
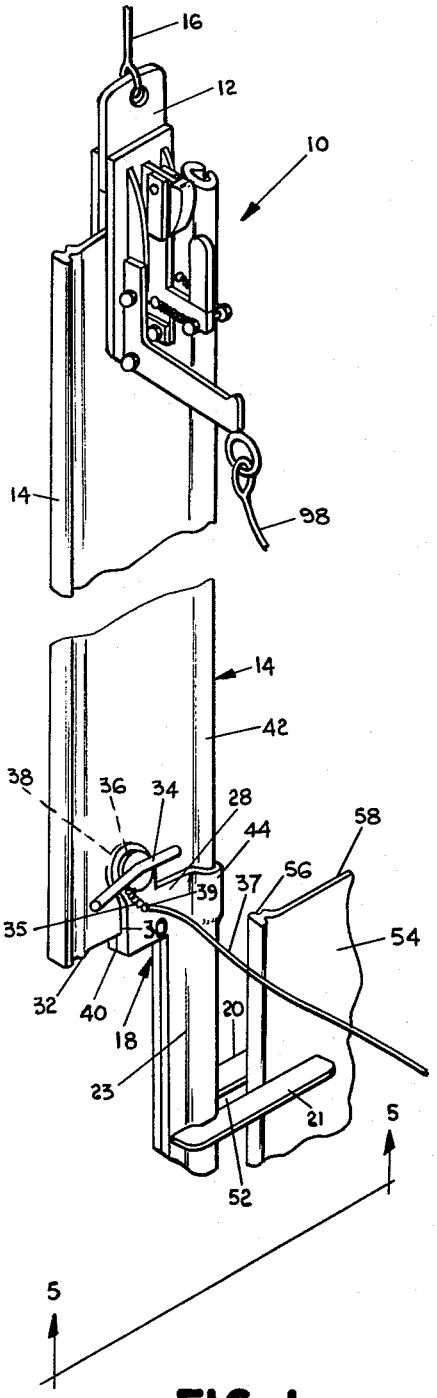
FIG. 1 is a front perspective view of an embodiment of the invention.

Referring now to the drawings and more particularly to FIG. 1, a piling alignment system 10 used for aligning pile sections whereby complementary interlocking edges of adjacent pile sections are locked together forming a wall of pile sections has a releasable shackle 12 to suspend a pile section 14. The shackle 12 is attached to a cable 16 which is operably connected to a crane (not shown). At a bottom portion of the suspended pile section 14 is attached a pile setter 18.

Figure 2:
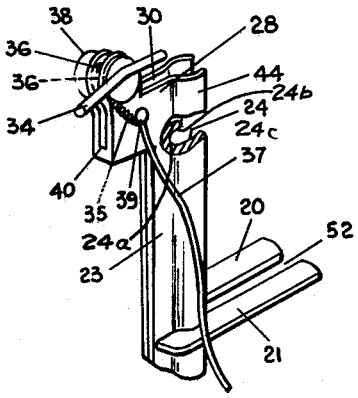
FIG. 2 is a partially broken front perspective view of the pile setter as shown in FIG. 1.

As more clearly shown in FIG. 2, the pile setter 18 has two prongs 20 and 21 horizontally attached to a vertical member 23. The prongs 20 and 21 are attached to the back and front sides of the vertical member 23 respectively so a space 52 exists therebetween. The vertical member 23 has a groove 24 which extends downwardly through space 52 between the prongs 20 and 21 the groove 24 has front surface **24*a* and two side surfaces 24*b* and 24*c*. The pile setter 18 has an upper lip portion 28 that has a space 30 therebetween which can receive the lower edge 32 (as shown in FIG. 1) of a suspended pile section 14. A threaded fastener 34 engages apertures 36 of the lip portion 28. The threaded fastener also secures the suspended pile section 14 through an aperture 38. The threaded fastener 34 is connected to a chain 35. The chain 35 has its other end secured to the upper lip portion 28 at mount 39. A rope 37 is connected to the pile setter 18 at the mount 39** and is of sufficient length to be operable from ground level.

Figure 4:
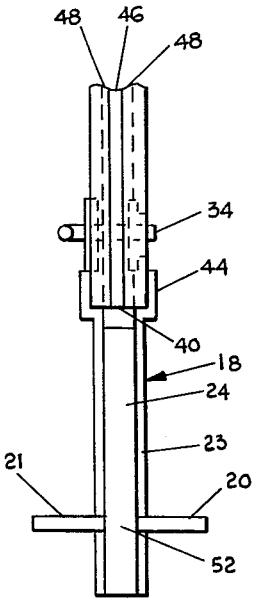
FIG. 4 is a side elevational view of the pile setter as shown in FIG. 1 as shown in engagement with a suspended pile section.

As shown in FIGS. 1 and 4, when the threaded fastener 34 engages the suspended pile section 14, the suspended pile section is seated within the space 30 and on ledge 40 at a lower portion of the lip portion 28. A female interlocking edge 42 of the suspended pile section 14 is seated within a widened section 44 of the lip portion 28. The groove 24 is aligned underneath the rear surface 46 of the female interlocking edge 42.

Figure 5:
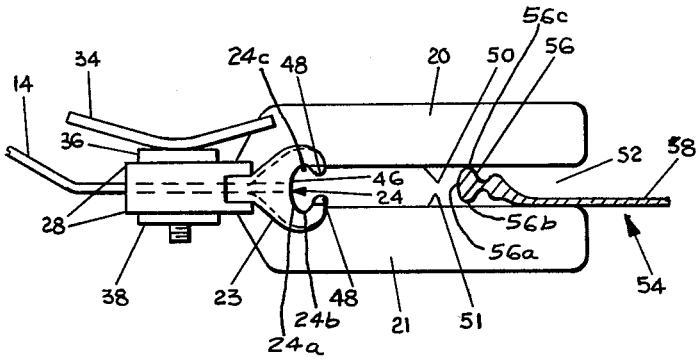
FIG. 5 is a bottom elevational view of the pile setter taken along the lines 5—5 as shown in FIG. 1.

The groove 24 within the vertical member 23 can be made from the female interlocking edge 42 of a piling by removal of the converging flanges 48. Referring to FIG. 5, the groove 24 can be seen aligned with the back surface 46 of the female interlocking edge 42. The back prong 20 has its inner edge 50 aligned with the outer edge of the groove 24. The front prong 21 has its inner edge 51 spaced slightly outwardly from the outer edge of the groove 24. The space 52 between the two prongs 20 and 21 can receive a set pile section 54 wherein the male interlocking edge 56 of the pile section 54 abuts the inner edge 50 of prong 20. The flat wall section 58 of the pile section 54 is adjacent to the inner edge 51 of prong 21.

As shown in FIGS. 4 and 5, the groove 24 has no converging flanges. The male edge 56 of the set pile section 54 has a front portion **56*a* and sides 56*b* and 56*c*. The male edge has a width slightly narrower than the width of the groove so as to allow the male edge 56 of set pile section 54 to laterally engage the groove 24 such that the front portion 56***a* and sides 56*b* and 56*c* of the interlocking male edge 56 but respectively the front portion of 24*a* and sides 24*b* and 24*c* of the groove. The male edge 56 also has a width wider than the distance between the two converging flanges 48 of the female interlocking edge 42 to make a positive locking engagement between the two edges.

Figure 3:
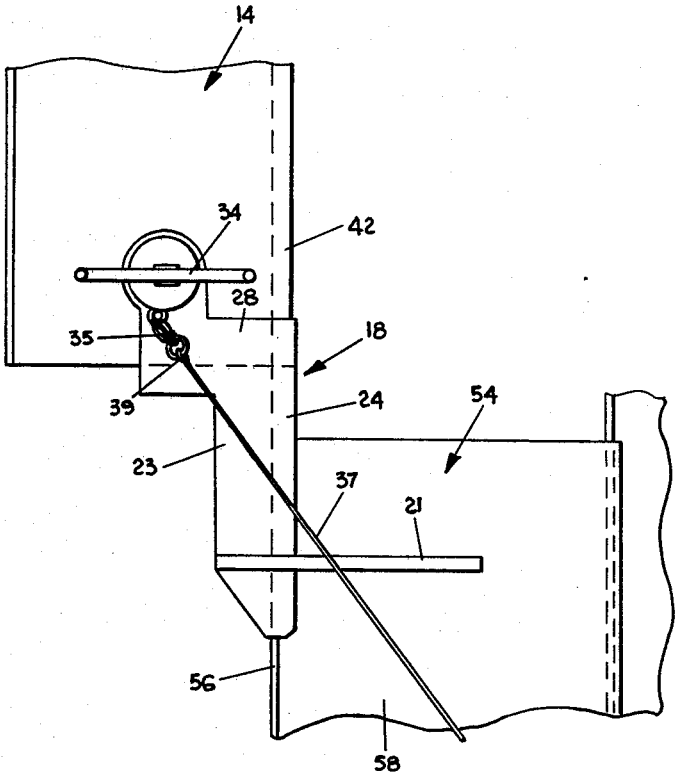
FIG. 3 is a front elevational view of the pile setter wherein a set pile section is aligned with a suspended pile section.

As shown in FIG. 3, when the male edge 56 of the set pile section 54 is abutting the longitudinal extent of the groove 24, it lies underneath the female interlocking edge 42 of the suspended pile section 14. The male edge 56 snugly fits within the groove so that the two edges are congruent. The edges must be exactly aligned in all respects in order for the female edge to slide down surrounding the male edge. If the skews are different, the suspended piling won't slide down even though the top edge of the male edge may be engaged by the bottom edge of the suspended female edge.

Figure 6:
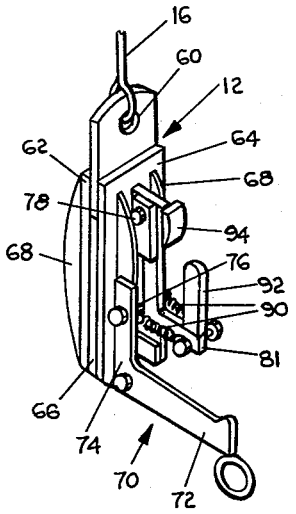
FIG. 6 is a front perspective view of the shackle as shown in FIG. 1.
Figure 7:
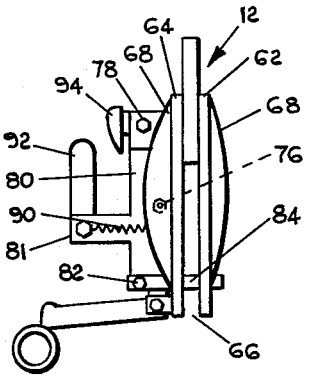
FIG. 7 is a side elevational view of the shackle as shown in FIG. 6.

Referring to FIGS. 6 and 7, the quick release shackle 12 has an aperture 60 through an upper portion to engage cable 16. The shackle 12 has a back vertical extension 62 and a front vertical extension 64 with a space 66 therebetween. For arced supports 68 are at each outer surface of the vertical extensions 62 and 64 and running substantially the length thereof. Pivotably mounted to a bottom section of the front surface of the front vertical extensions 64 is a lever member 70. The lever member has a lower outward portion 72 and an upward vertical portion 74. Pivotably connected at point 78 at an upper portion of the front vertical extension 64 is an arm 80. Arm 80 has an outwardly extending member 81.

As more clearly shown in FIG. 7, a bottom portion of arm 80 at pivot point 82 is a pin 84. The pin extends through the vertical extensions 62 and 64 and spans the space 66 therebetween. The rod 76 abuts the arm 80 at an inside edge between the pivot point 78 and pivot point 82.

The outwardly extending member has two springs 90 connected at an outer portion thereof. The springs extend to and are secured to the front vertical extension 64. A handle 92 is mounted on the extending member 81 and protrudes upwardly. Spaced apart from the handle 92 and mounted rigidly to the shackle is an overhanging lip section 94.

In operation, the piling alignment system 10 has its shackle 12 mounted on an upper portion of the suspended pile section 14. Handle 92 can be grasped and pulled away from the vertical extension 64 so that arm 80 pivots away from the vertical extension 64 and the pin 84 pulls forward to disengage from the rear vertical extension 62 and withdraws from space 66. Overhanging lip section 94 will abut the handle 92 to prevent the arm 80 from being pivoted too far so as to disengage the pin 84 from the front vertical extension 64. The pin 84 is aligned with an aperture through the upper portion of the pile section 14 which can be either in a horizontal position resting on the ground or a vertical upright position. Handle 92 is then released whereby springs 90 will retract on arm 80 and push the pin 84 back through the aperture in the pile section 14 and the aperture in the rear vertical extension 62.

A crane then lifts the shackle and suspends the pile section 14. At this point wherein the lower edge 32 of the pile section 14 is within easy reach, the pile setter 18 is attached to the bottom portion of the pile section 14 through threaded fastener 34. Previously set pile 54 is then received within the space 52 between the prongs 20 and 21. The suspended pile section 14 is then elevated so its lower edge 32 is above the top edge 96 to the set pile section 54 but wherein prongs 20 and 21 still engage the pile section 54.

At this point, the rope 37 can be pulled by an operator at ground level to adjust the suspended pile section and laterally move it toward the set pile section 54. At this point, the male interlocking edge 56 will abut groove 24 and the male interlocking edge 56 is aligned vertically under the female interlocking edge 42. The crane then lowers the suspended pile section 14 wherein the two interlocking edges 42 and 56 will interlock. When lowered so the pile setter 18 is within easy reach, the pile setter may be detached from the suspended pile section 14 by removing threaded fastener 34. The pile section 14 can then be set into plate.

Figure 8:
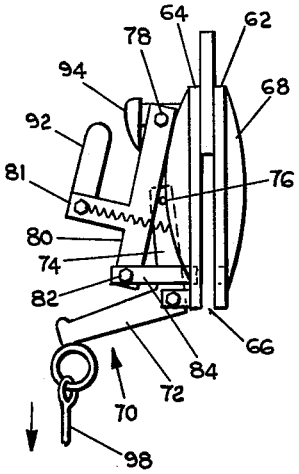
FIG. 8 is a side elevational view of the shackle shown in the release position.

At this point, the quick release shackle 12 can be released by a man at ground level by pulling on lanyard 98 which is attached to ring 73. As shown in FIG. 8, when lanyard 98 is pulled downward, the lever member 70 has its lower outward portion 70 pulled downward and its upward vertical portion 74 pulled away from the vertical extension 64. Rod 76 forces arm 80 to pivot outwardly from the front vertical extension 64 to withdraw pin 84 from the space 86 between the two extensions. At this point, the pile section 14 is disengaged from the shackle 12.

The above operation may be repeated wherein the pile section 14 can have its other edge which has a male interlocking edge interlocked with a new suspended pile section.

The pile alignment system 10 provides a system for interlocking piling without the use of a man atop the piling and to assure the two adjacent pile sections have aligned skews. The pile alignment system can be used in rough weather where there may be rain and high winds. There are no portions of either the shackle or setter that may bind and render the alignment system inoperative.

The only manual tasks required are the attachment of the shackle and pile setter onto the pile section 14, the quidance of the setter 18, and the subsequent detachment of the shackle and setter. Both of these parts can be attached and detached from pile section 14 at ground level where a man is safe from the dangers of high winds or swinging pile sections. The setter can be guided by use of rope 37 from ground level.

It should be understood that the foregoing embodiment of the invention is merely illustrative of the preferred practice of the invention and that various changes and modifications may be made in the arrangements and details of the embodiments described herein without departing from the spirit and scope of the invention.

The embodiments of the invention in which an exclusive property or privilege is claimed are defined as follows:

1. In a system for assembling pile sections that have male and female interlocking edges including a means for suspending a pile section at an upper portion thereof and means for aligning adjacent interlocking edges wherein said aligning means include means for fixedly attaching the aligning means to a bottom section of the suspended pile section, means for retaining an interlocking edge of an adjacent set pile section in close approximate lateral alignment to the interlocking edge of the attached pile section, and means for guiding the aligning means from a remote distance so that an operator can guide the aligning means from the ground; the improvement in the aligning means comprises:

means in an immovable and rigid position with respect to the suspended pile section with front and side surfaces for laterally accepting the interlocking edge of the set pile and for abutting side and front portions of the interlocking edge of the set pile along vertically varying positions thereof such that the front and side surfaces precisely align the interlocking edges of the suspended and set pile sections when the front and side edges are in abutment with the side and front portions of the interlocking edge of the set pile whereby the suspended pile edge is not skewed with respect to the set pile edge.

2. A system as defined in claim 1 wherein the abutting means is a groove shaped to enclose the set pile edge so that when the set pile edge is abutting the surface of the groove, the set edge is in alignment with the suspended pile edge.

3. A system as defined in claim 2 wherein the aligning means is attached to the suspended pile section so the groove has its surface congruent with the interior surface of a female interlocking edge of the suspended pile without the converging flanges of the female interlocking edge which provides for positive locking so as to allow a male interlocking edge of the set pile section to move laterally into the groove.

4. A system as defined in claim 2 wherein the aligning means has a lip portion extending upwardly and around the top edge of the groove portion and shaped to fit a bottom edge of the pile section; the groove is adapted to be congruent with an edge of the attached pile section when the pile section is sitting within the lip portion.

5. A system as defined in claim 3 wherein the retaining means includes two prongs one on each side of the groove at a bottom portion thereof and extending laterally with sufficient space therebetween to allow a set pile section to be positioned therebetween; the prongs have sufficient length to effectively retain the set pile section within the space therebetween.

6. A system as defined in claim 3 wherein the attaching means includes at least one aperture through the aligning means and fasteners extending through the aperture and extending through an aperture through a bottom portion of the suspended pile section such that the groove is placed directly below the female edge of the suspended pile section and aligned therewith.

7. A system as defined in claim 1 wherein the guiding means comprises a lanyard means attached to the aligning means and operable from ground level to control the horizontal movement of the aligning means.

8. A system as defined in claim 1 wherein the means for suspending the pile system comprises:

a shackle adapted to be suspended and having spaced flanges adapted to receive the suspended pile section therebetween;

a protrusion operatively connected to the shackle and adapted to engage an aperture within a top part of the pile section for securing the pile section to the shackle; and means for remotely operating the protrusion between an engaging and disengaging position.

9. A system as defined in claim 8 wherein the protrusion is adapted to extend through the two flanges and be withdrawn from one aperture and the space between the two flanges for disengagement with the pile section.

10. A system as defined in claim 9 wherein the remote operating means comprises:

a lever pivotably connected to an outer lower portion of the shackle;

a line connected to an outer end of the lever and operable from a ground position;

a protrusion arm pivotably connected to an upper portion of the shackle;

the protrusion arm pivotably connected at a lower portion thereof to an end of the protrusion;

an upward extension of the lever in engagement with a protrusion arm at a point between the pivotable connection to the protrusion and the pivotable connection to the shackle adapted to pull away from the flange when the line is pulled downward which pivots the lever and engaged to the protrusion arm so as to pivot the protrusion arm away from the flange which pulls the protrusion out from the aperture of the rear flange and disengages it from the pile section; and a spring means connected between the protrusion arm and front flange to automatically return the protrusion to engagement with the aperture of the rear flange when tension on the line ceases.

11. A system for assembling pile sections that have male and female interlocking edges including means for aligning adjacent interlocking edges and a means for suspending the pile section at an upper portion thereof wherein the improvement in the means for suspending the pile section comprises:

a shackle adapted to be suspended and having spaced flanges adapted to receive the suspended pile section therebetween;

a protrusion operatively connected to the shackle and adapted to engage an aperture within a top part of the pile section for securing the pile section to the shackle; and means for remotely operating the protrusion between an engaging and disengaging position.

12. A system as defined in claim 11 wherein the protrusion extends through the two flanges and can be withdrawn from one aperture and the space between the two flanges for disengagement with the pile section.

13. A system as defined in claim 12 wherein the remote operating means comprises:

a lever pivotably connected to an outer lower portion of the shackle;

a line connected to an outer end of the lever and operable from a ground position;

a protrusion arm pivotably connected to an upper portion of the shackle;

the protrusion arm pivotably connected at a lower portion thereof to an end of the protrusion;

an upward extension of the lever in engagement with a protrusion arm at a point between the pivotable connection to the protrusion and the pivotable connection to the shackle adapted to pull away from the flange when the line is pulled downward which pivots the lever, and engaged to the protrusion arm so as to pivot the protrusion arm away from the flange which pulls the protrusion out from the aperture of the rear flange and disengages it from the pile section; and a spring means connected between the protrusion arm and front flange to automatically return the protrusion to engagement with the aperture of the rear flange when tension on the line ceases.

* * * * *